US008111021B2

(12) United States Patent
Snijder et al.

(10) Patent No.: US 8,111,021 B2
(45) Date of Patent: Feb. 7, 2012

(54) LIGHTING SYSTEM AND A METHOD FOR CONTROLLING A LIGHTING SYSTEM

(75) Inventors: Pieter Jacob Snijder, Eindhoven (NL); Anthonie Hendrik Bergman, Eindhoven (NL); Gerritjan Henri Cowan, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 848 days.

(21) Appl. No.: 12/095,032

(22) PCT Filed: Nov. 28, 2006

(86) PCT No.: PCT/IB2006/054475

§ 371 (c)(1),
(2), (4) Date: May 27, 2008

(87) PCT Pub. No.: WO2007/063487

PCT Pub. Date: Jun. 7, 2007

(65) Prior Publication Data

US 2008/0309259 A1 Dec. 18, 2008

(30) Foreign Application Priority Data

Dec. 1, 2005 (EP) ..... 05111574

(51) Int. Cl.
*H05B 37/00* (2006.01)

(52) U.S. Cl. ..... 315/312; 315/291; 315/318

(58) Field of Classification Search ..... 315/291, 315/307–308, 312–313, 314–318
See application file for complete search history.

(56) References Cited

U.S. PATENT DOCUMENTS

| | | | | |
|---|---|---|---|---|
| 4,747,862 | A | 5/1988 | Haisma et al. | |
| 5,769,527 | A | 6/1998 | Taylor et al. | |
| 6,065,854 | A | 5/2000 | West et al. | |
| 6,806,659 | B1 | 10/2004 | Mueller et al. | |
| 7,309,965 | B2 * | 12/2007 | Dowling et al. | 315/318 |
| 7,550,931 | B2 * | 6/2009 | Lys et al. | 315/291 |
| 7,642,730 | B2 * | 1/2010 | Dowling et al. | 315/292 |
| 2002/0180719 | A1 | 12/2002 | Nagai et al. | |
| 2003/0189412 | A1 * | 10/2003 | Cunningham | 315/312 |
| 2004/0100796 | A1 | 5/2004 | Ward | |
| 2004/0160199 | A1 * | 8/2004 | Morgan et al. | 315/312 |
| 2005/0116667 | A1 | 6/2005 | Mueller et al. | |

* cited by examiner

*Primary Examiner* — Tung X Le

(57) ABSTRACT

A method of controlling a lighting system includes a learning procedure. The lighting system includes lighting modules and a controlling device. The lighting modules are arbitrarily arranged, and each lighting module can communicate with neighboring lighting modules via communication units arranged at sides of the lighting module. The learning procedure defines a lighting module arrangement and a communication network for communication between the controlling device and the lighting modules. During the learning procedure, a token is forwarded from one lighting module to another lighting module, while ensuring that all lighting modules are visited by the token. Further, geometric information about how the lighting modules are arranged in relation to each other is generated.

20 Claims, 8 Drawing Sheets

LIGHTING SYSTEM AND A METHOD FOR CONTROLLING A LIGHTING SYSTEM

FIELD OF THE INVENTION

The present invention relates to a method for controlling a lighting system, which is built-up from polygonal lighting modules and a controlling device, and to such a system.

BACKGROUND OF THE INVENTION

Lighting systems of the kind referred to here generally consist of polygonal lighting modules, i.e. light emitting modules, which are arranged to form an arrangement of a desired shape and size. For example, walls are fully or partly covered with a lighting module arrangement for displaying large images, or three-dimensional structures are formed for aesthetic applications.

One lighting system is disclosed in published US patent application No. 2005/0116667 A1. In that prior art system the lighting modules are thin building blocks called tiles, and each lighting module has several communication units, or ports, which are located one at each side of the lighting module. The lighting modules are arranged in a network for communication between the common controlling device and the lighting modules. The communication port can receive data from the controlling device through wired or wireless transmission.

US 2005/0116667 A1 is very general as to how solutions are actually implemented. One particular problem is how to make the lighting system as free as possible when it comes to how to arrange the lighting modules. Thus, it is desirable that they can be arranged in an arbitrary arrangement as regards shape and size thereof, and that the arrangement can be changed in an easy way. In this respect, the US 2005/0116667 A1 discloses little useful information. The following is disclosed in US 2005/0116667 A1. The lighting modules can either have a unique ID or an ID that represents the type of lighting module. When the lighting modules are connected edge-to-edge electrically through edge connections, there can be a handshaking routine to communicate between the lighting modules and provide information to each other. To determine the overall topology a sequence of communications from one lighting module to the next to the central controlling device. The connections between lighting modules allow a path of communication to determine the configuration of the complete installation.

Thus, there is no complete explanation of how to actually perform the determination of the topology, i.e. the size and shape of the arrangement of lighting modules.

SUMMARY OF THE INVENTION

It is an object of the present invention to provide a method of controlling a lighting system and a lighting system that alleviates the above-mentioned drawbacks of the prior art.

The invention is based on an insight that by providing an appropriate way to detect all lighting modules which are arranged in a geometrical cluster it is possible to obtain a self-configuration system wherein the controlling device has knowledge about the size and shape of the cluster, and is able to present a lighting appearance as desired.

Thus, in accordance with an aspect of the present invention, there is provided a method of controlling a lighting system, which system comprises a plurality of polygonal lighting modules and a controlling device, which are able to communicate with each other, wherein said lighting modules are arbitrarily arrange able by each lighting module being able to communicate with neighboring lighting modules via communication units arranged at several sides of the lighting module, the method comprising:

performing a learning procedure for defining a lighting module arrangement and a communication network for communication between the controlling device and the lighting modules;

wherein the learning procedure comprises:

forwarding a token from module to module, while ensuring that all lighting modules are visited by the token; and concurrently obtaining geometric information about how the lighting modules are arranged in relation to each other.

The use of a token that is circulated among the lighting modules in such a way that all lighting modules are visited makes it possible to acquire information about the structure. Accordingly, geometric information is indeed concurrently obtained, while the token is circulated.

In accordance with an embodiment of the method, the lighting modules are provided with an address when the token first arrives there. After each assignment the address is updated to ensure that the same address is not provided to two different modules. Thus, the lighting modules do not have to have any predefined addresses, which additionally enhances reconfigurations of the lighting module arrangement.

In accordance with embodiments of the method, the provision of geometric information includes generating directional information about the direction in which the token moves. This directional information is used by the controlling device to determine size and shape of the lighting module arrangement. This use of movement direction is an advantageous example of how to build a map of the arrangement bit by bit.

In accordance with embodiments of the method, the internal orientation of the lighting modules is synchronized. Thereby, the lighting modules can be arbitrarily rotated when they are put together to form the lighting module arrangement.

In accordance with an embodiment of the method, it is ensured that the lighting module, during the learning procedure, knows the direction back to the controlling device.

In accordance with an embodiment of the method, the lighting modules can be set in an idle state where they are ready to receive communication from any side. By using this state as a default state, it is ensured that predefined data paths through the lighting module arrangement are not needed.

In accordance with an embodiment of the method, an optimization procedure is performed, which generates an optimized data path through the lighting module arrangement. This data path is used by the controlling device for feeding data to the lighting modules. If more optimum, then several data paths are configured.

In accordance with an embodiment of the method, the knowledge about the lighting module arrangement, for example the size and shape thereof, is used for the optimization.

In accordance with an embodiment of the method, communication units of the lighting modules are defined as either receive only or send only units. This is done methodically such that a unidirectional data path is created.

In accordance with another aspect of the present invention, there is provided a lighting system, which system comprises a plurality of polygonal lighting modules and a controlling device, which are able to communicate with each other, wherein said lighting modules are arbitrarily arrange able by each lighting module being able to communicate with neighboring lighting modules via communication units arranged at several sides of the lighting module These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
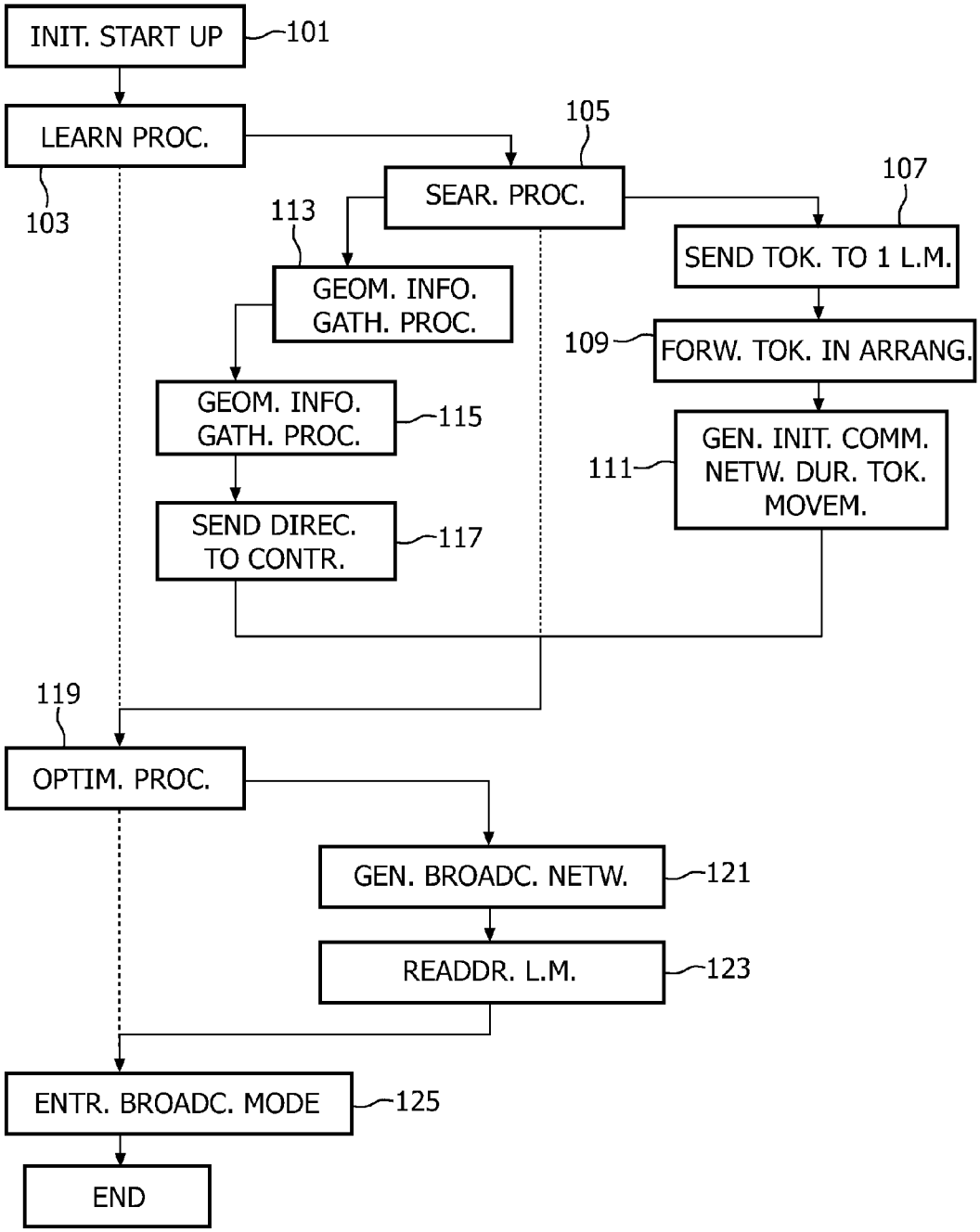
FIG. 1 is a flow chart of an embodiment of the method for controlling a lighting system according to the present invention.
Figure 2:
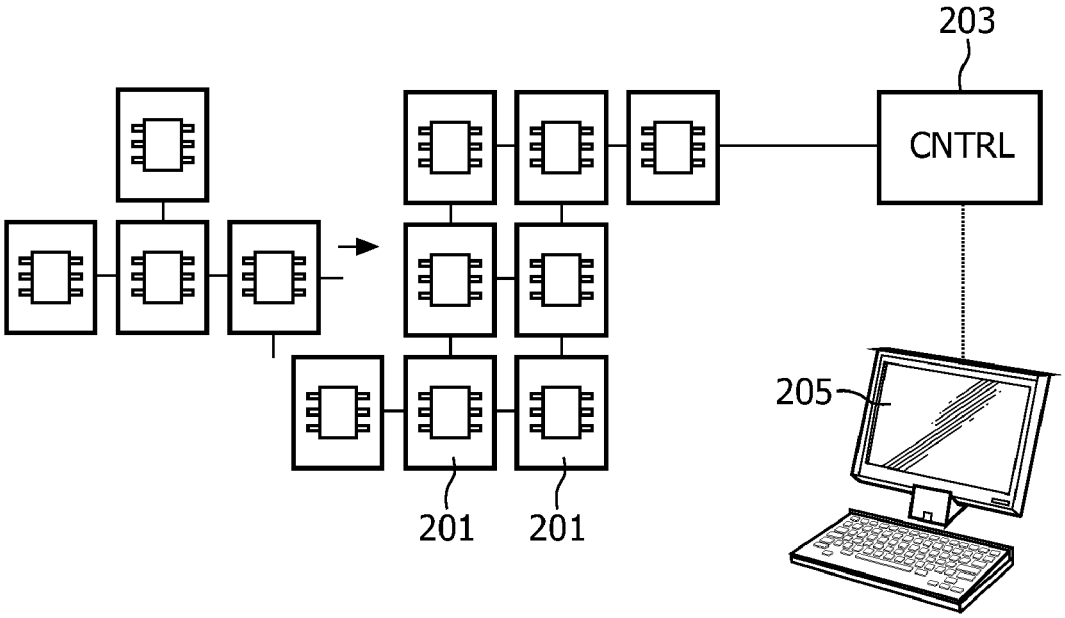
FIG. 2 is a schematic block diagram of an exemplifying lighting system.
Figure 6:
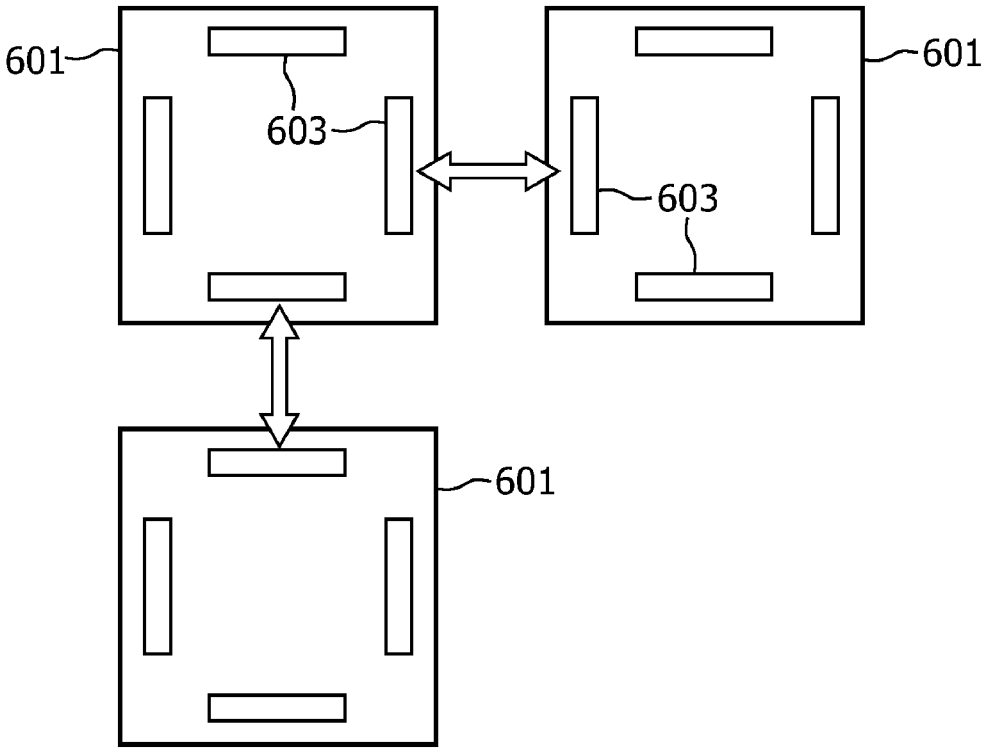
FIG. 6 is a schematic block diagram of an arrangement of lighting modules according to an embodiment of the lighting system of the present invention.
Figure 7:
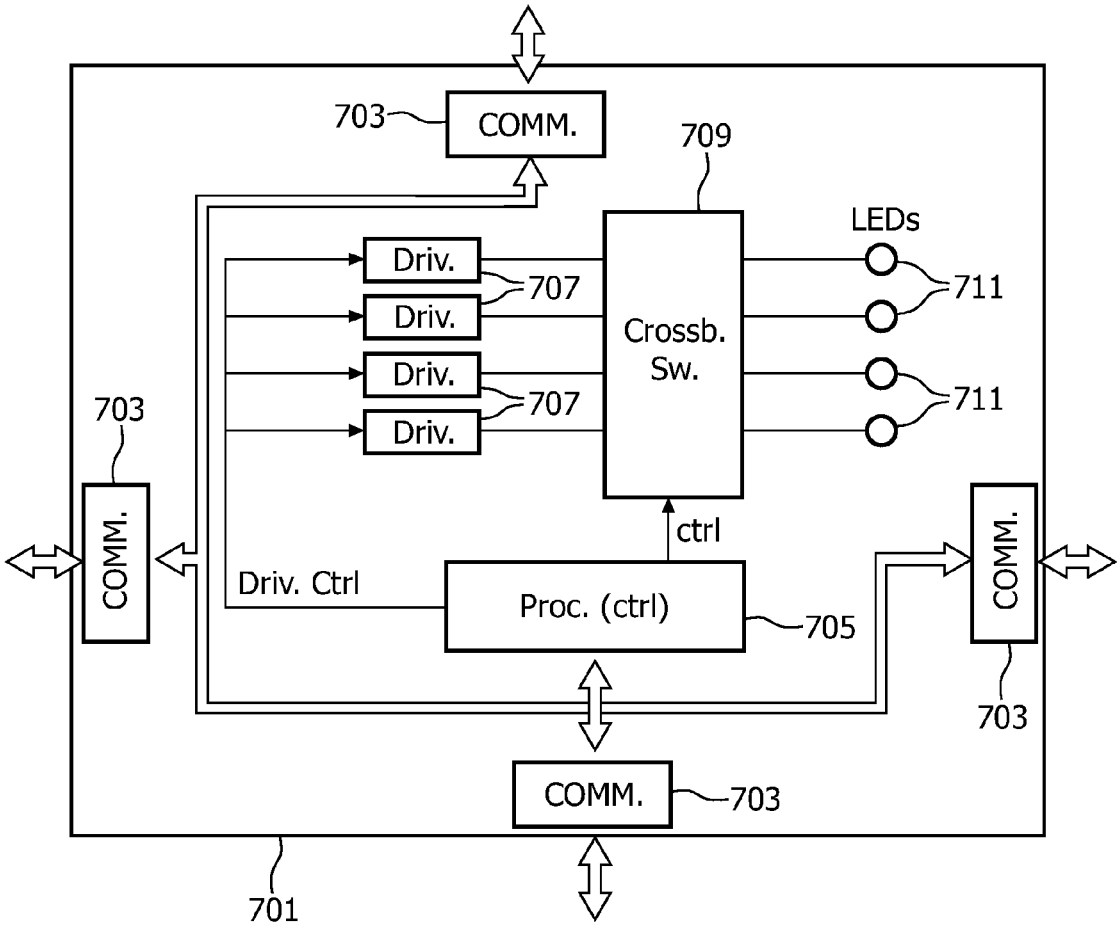
FIG. 7 is a schematic block diagram of a lighting module of an embodiment of a lighting system according to the present invention.

Referring to FIG. 2 a lighting system comprises several lighting modules 201, a controlling device 203, and a PC (Personal Computer) 205. Each lighting module 201 contains one or more light sources, as shown in FIG. 7. The lighting modules 201 are polygonal. For example, they are rectangular in FIG. 2 and square in FIG. 3. For purposes of simplicity only two-dimensional arrangements of thin lighting modules, or tiles, 201 are shown in this application, while three-dimensional arrangements are possible as well. As shown in FIG. 6, the lighting modules 601 are able to communicate with each other by means of communication units 603. In the embodiment as shown, the communication units of each lighting module 601 are located one at each side of the lighting module 601. Consequently, in the embodiments shown the lighting modules 201, 601 are able to communicate with four neighboring lighting modules 201, 601. However, the number of neighbors can vary from one to four.

The lighting modules 201 are interconnect able by mechanical as well as electrical connections. These can for example be provided as means for clicking or dovetailing the lighting modules 201 together. For the purposes of this application any connection type that is able to provide an appropriate function is useful. The electrical connections comprise power connections as well as communication connections, and they can be either separated or common. At least as regards the connections of communication they can be wired as well as wireless. The mechanical connections can be either provided at the lighting modules 201, or some kind of support structure for supporting the lighting modules 201 can be used. One of the lighting modules 201 of the lighting module arrangement is additionally connected to the controlling device, via one of its communication units 603. Further the PC 205 is connected to the controlling device 203. The controlling device 203 controls the displaying of lighting patterns, such as images, videos, etc., by means of the lighting module arrangement. The PC 205 is used for assisting the controller in creating and/or adapting the lighting patterns, and for previewing the lighting patterns to be displayed. In other embodiments, the PC 205 constitutes the controlling device 203.

Referring to FIG. 7 some of the circuitry comprised in each lighting module is schematically shown. Four communication units 703 are connected via an internal bus to an internal processor 705. Each communication unit is basically an I/O unit that is settable in different modes, including a receive only mode and a send only mode. Further, the processor is connected to one or, typically, several LED drivers 707, which are connected to a crossbar switch 709. The crossbar switch 709 is, in turn, connected to one or more LEDs 711. The processor is also connected directly to the crossbar switch for controlling purposes. Illumination data that is received by one of the communication units 703 is fed to the processor 705, which generates control signals to the LED drivers 707 for powering the LEDs 711. The powering signals are fed via the crossbar for reasons to be explained below.

Referring in particular to FIGS. 1, 3, 4 and 5*a-c*, an embodiment of the method according to this invention at start up, box 101 of the flow chart, of the lighting system begins with a learning procedure, box 103. In this embodiment start up occurs automatically when the lighting module arrangement has been built-up for the first time, when the system is reset after a modification of the arrangement, or for some other reason, and when a lighting module is added or removed while the system is running. The learning procedure is performed for defining the size and shape of the arrangement and for establishing a communication network for communication between the controlling device and the lighting modules 301. The learning procedure begins with a search procedure, box 105, which begins with the controlling device 303 sending a unique explorer token into the arrangement, box 107, and more particularly to a first lighting module 301 thereof, which is directly connected to the controlling device 303. The token is then forwarded by the first lighting module 301 to the next one, which is a neighbor, etc., box 109. The learning procedure is arranged such that it is ensured that all lighting modules 301 are sequentially visited at least once by the token. During this search procedure all communication units of the lighting modules 301 are receiving by default.

From start all lighting modules 301 are in a non-visited state, where they are receiving at all sides. This state of reception, which can also be generally regarded as an idle state, may be entered at other occasions as well, as will be exemplified below. At some point in time each lighting module 301 will receive a presence inquiry from a neighbor lighting module 301. It will send a reply only at the side where the inquiry was received, and the result is stored by the inquiring lighting module 301 only. At some point in time each lighting module 301 will send a presence inquiry to its neighbors in order to find out at what sides there is a neighbor. The processing of these inquiries will be further explained below. The token is a particular message from the controlling device 303. A header of the message identifies it as the explorer token. When the token enters the first lighting module 301 it carries a unique address and an incoming side flag.

The initial start address is generated by and originates from the controlling device 303. Assume, for example, that the start address is A1. The lighting module 301 recognizes that this is the first time that the token is received at the lighting module 301 and therefore, the address A1 is assigned to the lighting module 301. After this assignment the address is updated, for example incremented to A2. The lighting module A1 then stores information, for example sets a flag, stating that it has been visited by the token. Further, the lighting module A1 recognizes at which side, that is at which communication unit 603, the token was received. For that matter the lighting modules 301 are provided with a default orientation defining up, down, left and right. However, in order to provide a freedom of mounting the lighting modules at an arbitrary rotation, this default orientation is compared with the incoming side flag of the token. If a discrepancy is detected, then the lighting module 301 adapts its orientation into correspondence with the incoming side flag. Then the incoming side information is stored at the lighting module A1.

The processor 705 of the lighting module A1 then initiates sending of presence inquiries from all sides but the one where the token was received. The replies are stored. Then the lighting module A1 prepares a new token to be forwarded to a neighboring lighting module 301. The preparation includes the following measures. A neighbor is located according to a preset order that is the same for all lighting modules 301. In this embodiment the order is down, left, right, and up. In the arrangement shown in FIG. 3, lighting module A1 determines that downwards is not possible, since the token was received at that side. Further, there is no lighting module 301 to the left or to the right, so it determines that the token should be sent upwards. If there is no accessible lighting module 301 in any direction the token will be provided with a transit flag and sent from the side where it entered the lighting module 301 for the very first time. When the token carries the transit flag the receiving lighting module 301 will not update its address. When this preparation is finished the lighting module A1 actually sends the token to the neighbor, where the same procedure as in A1 is executed. The address is updated to A2, which is assigned to this neighbor, and for the following lighting module 301 the address is again incremented, to A3, etc.

When a lighting module 301 has been visited by the token it has changed state into a visited state. In the visited state, the communication units on all sides are in a receiving, or listening, mode, just like they were initially. However, all communication units must keep quiet in that they are not allowed to respond to any presence inquiry. Consequently, the visited lighting modules 301 are hiding themselves to other lighting modules 301, and thereby they are considered as non-existing by the other lighting modules 301.

When the token carries a transit flag and enters a lighting module 301 being in the visited state, it will be handled as follows. The lighting module 301 has full knowledge of its neighbours, and in case the lighting module 301 has still one or more unvisited neighbours the transit flag of the token will be removed and the token will be sent to an unvisited neighboring lighting module 301 according to the rules described above. If the lighting module 301 has no unvisited neighbor the token will merely transit the lighting module 301 and will leave the lighting module 301 at the side where it was received by the lighting module 301 for the first time. No updates of token data will be performed. The search procedure ends when the token returns to the controlling device.

Figure 3:
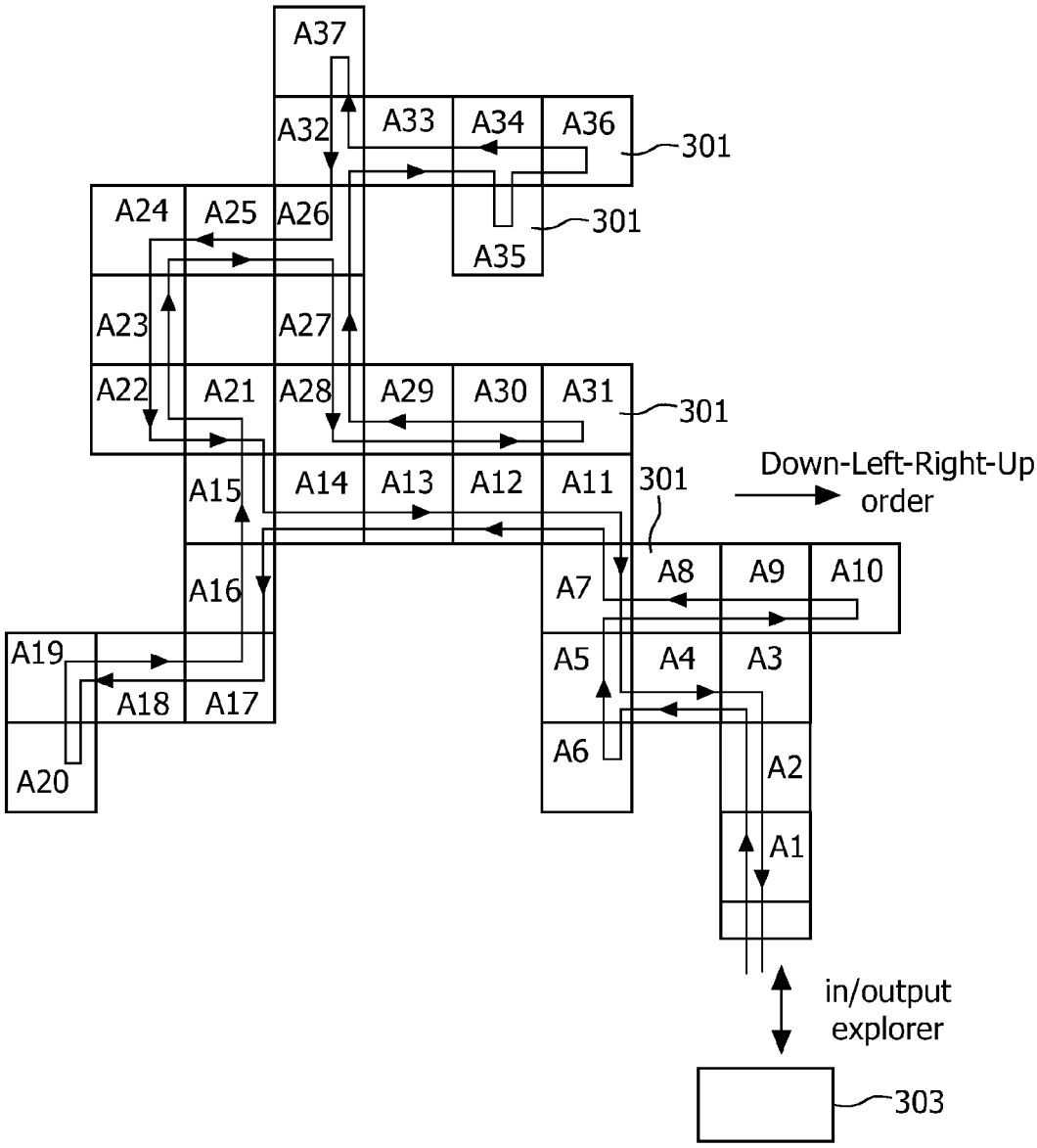
FIG. 3 is a schematic block diagram of a lighting module arrangement illustrating operations of an embodiment of the method for controlling a lighting system according to the present invention.

In this way the search procedure will render the situation as illustrated in FIG. 3. Individually unique addresses have been assigned to all thirty-seven lighting modules A1-A37 and an initial communication network for communication between the controlling device 303 and the lighting modules 301 has been created, box 111, along the route of the token.

However, the controlling device needs information about the structure of the arrangement, and efficient communication paths are desirable. Thus, in addition to the search procedure, the learning procedure includes a geometric information gathering procedure, and the method further includes an optimization procedure for optimizing the communication network.

The geometric information gathering procedure, box 113, includes the following processing. When a lighting module 301 has determined a direction to a neighboring lighting module 301, box 115, which is to be visited for the first time, it sends information about that direction back to the controlling device 303, box 117, from the side where the token was received for the first time. All previous lighting modules 301 along the route transits the direction information, and thereby the direction information ends up at the controlling device 303. Consequently, the controlling device 303 acquires knowledge about the arrangement bit by bit. When all lighting modules 301 have been visited the controlling device 303 has a complete picture of the arrangement.

Above, it has been explained that visited lighting modules 301 return certain information, such as geometric information, but also for example lighting module capabilities, and maintenance information, to the controlling device 303. In order to provide for such information sending operations, in one embodiment the token, while moving throughout the lighting module arrangement, is converting its trace into a unidirectional return data path way back to the controlling device by keeping communication units at the sides of the lighting modules 301 along this path in either sending or receiving state during the entire learning procedure. When the transit flag is set the token travels along this return data path as well. When the token arrives at a lighting module 301 having an unvisited neighbor it will proceed entering that and other unvisited lighting modules. Lighting modules residing along the return data path have already returned their information to the controlling device 303, so when the token is transiting it may break down that part of the return data path to the controlling device.

In another embodiment, visited lighting modules 301 fall back into their "listening only" mode immediately after the token has left the modules. Data is being sent back to the controlling device 303 through "data hopping". This means that visited lighting modules 301 located along the return path are passing data from one lighting module 301 to the next in the direction of the controlling device 303. This is accomplished by bringing the communication unit via which the token was received the first time in its sending state long enough to allow completion of data transfer to the next lighting module in the return path. It should be noted that when allowing only one lighting module 301 to send at a time, sufficient data storage capacity is needed in every lighting module 301 to hold all return data.

In addition to the direction information, in this embodiment lighting module properties, e.g. abilities and module dependent information such as elapsed lifetime, are sent back to the controlling device 303 as well. These properties are taken into account by the controlling device 303 later on when generating control data for the lighting modules 301.

Figure 4:
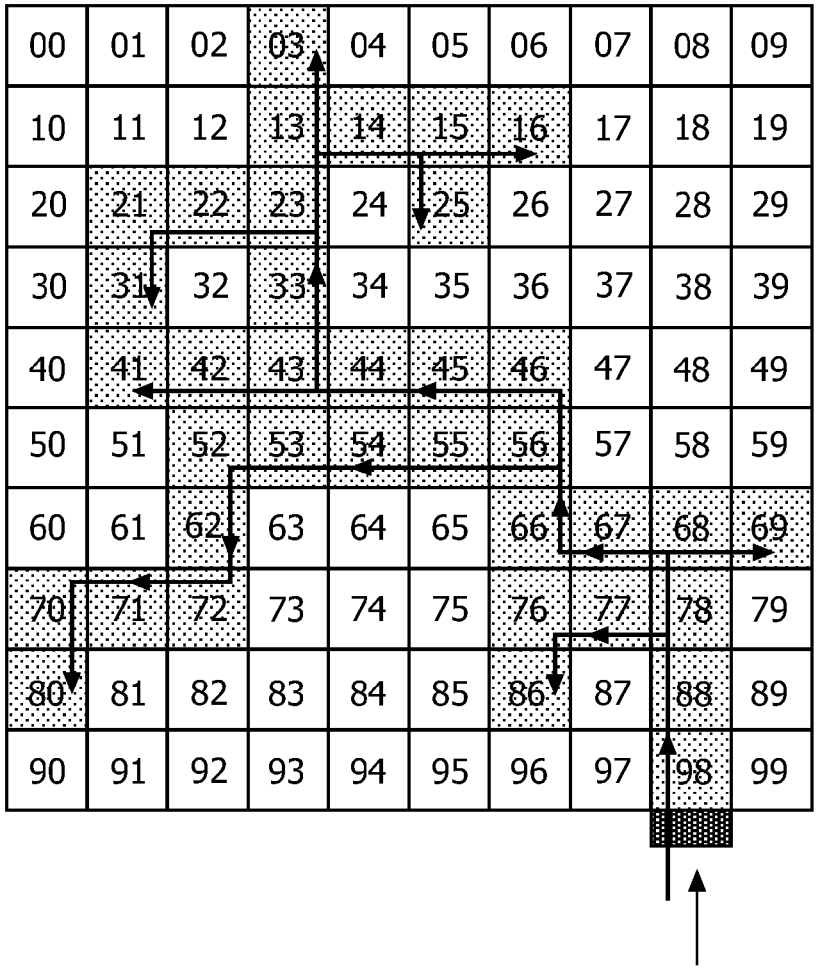
FIG. 4 is a schematic block diagram of a lighting module arrangement illustrating further operations of the embodiment of FIG. 3.

During the optimization procedure, box 119, the controlling device 303 modifies the initial communication network into an as short as possible broadcasting network, box 121. The broadcasting network consists of one or more unidirectional data paths, or branches, originating from the output of the controlling device 303 distributing RGB (Red Green Blue) data among all lighting modules 301. One example of the resulting broadcasting network is shown in FIG. 4. During this optimization procedure all lighting modules 301 are provided with new, more logical X, Y addresses, box 123, facilitating the lighting pattern generating task. Further, by sending communication control data from the controlling device 303 to the lighting modules 301, in each lighting module 301 one of the communication units 703 is set in a receive data only state, and, if there is a neighboring lighting module 301 farther from the controlling device, one communication unit is set in a send data only state. More particularly, when the learning procedure has been finished, all lighting modules, apart from those residing in the return data path, are listening only. The controlling device 303 starts optimization by sending a message to the closest lighting module 301 that it is connected to. This message contains instructions for that lighting module 301 about which communication unit should be receiving and which should be sending, i.e. transmitting, continuously. Now, the broadcasting network has become one lighting module long. Next, the second lighting module in the chain, following the already instructed one, is receiving similar instructions via the already established part of the broadcasting network. This way the broadcasting network is established lighting module by lighting module until the whole network has been completed.

When the optimization procedure is finished, the lighting system is set in a data broadcast mode, box 125, wherein all lighting modules 301 are continuously supplied with RGB data for driving the LEDs 711 of the modules in order to generate a desired lighting pattern. Each lighting module 301 will only acquire those parts of the broadcasted data that carry a corresponding address.

Figure 9A:
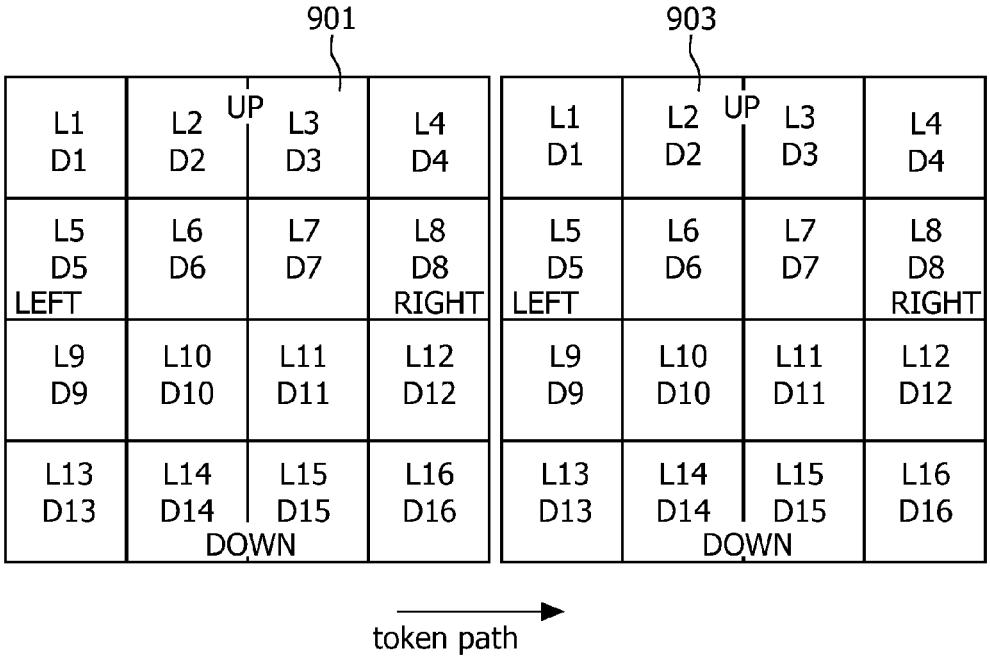
FIGS. 9*a-b* illustrates lighting module re-orientation.
Figure 9B:
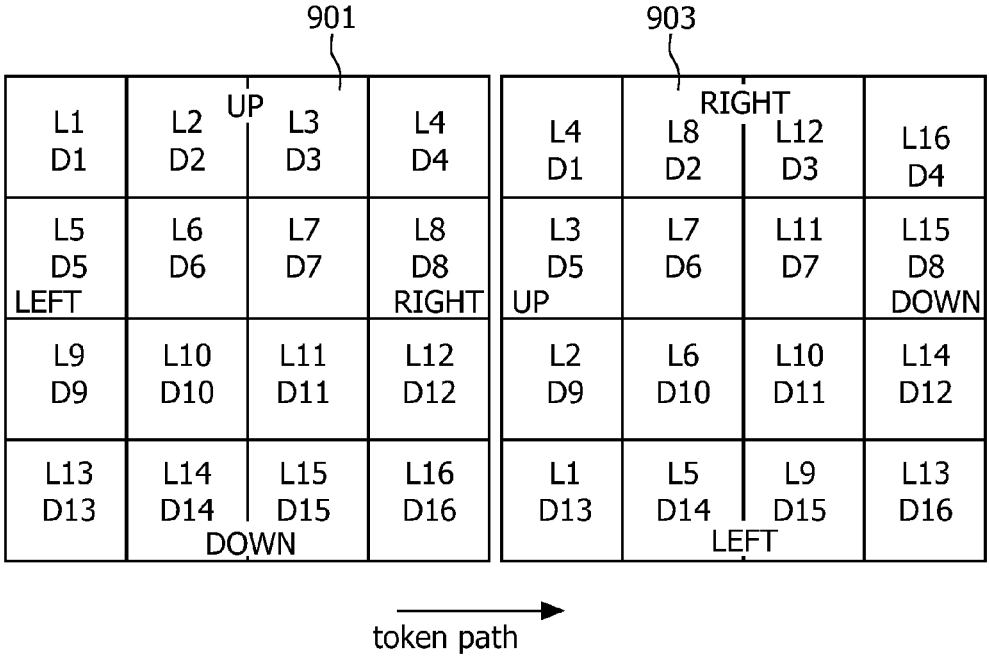

When having more than one LED or more than one RGB LED group in a lighting module the mounting thereof becomes rotational sensitive. That is one has to know which side of the lighting module represents "up". Otherwise, the lighting pattern will become erroneous. As explained above, this invention provides a rotational, or orientational, freedom. This freedom is obtained by employing the rotation correction as described above. That is, when the token enters a lighting module 903, 907 it carries direction data saying, for example, that it leaves from the right side of the lighting module 901, 905. Then if the default orientation of the receiving lighting module 903, 907 says anything else but the that the receiving side is the left side, the orientation of the receiving lighting module 903, 907 has to be corrected. This is illustrated in FIGS. 9*a*-*b*. In FIG. 9*a* the receiving lighting module 903 is already correctly oriented, while in FIG. 9*b* the receiving lighting module 907 has to be reoriented by rotating the directions clockwise 90 degrees. As a result, a viewer will perceive a physically non-rotated lighting module, while internally the lighting module 907 will present itself as a properly upwards-rotated lighting module when transferring directional information to neighboring lighting modules and to the controlling device. This means, for instance, that the token carrying directional data saying "leaving right side" will leave the corrected lighting module 907 at its physical down side.

One way of obtaining such a correction is by employing the crossbar switch 709 shown in FIG. 7. The processor 705 of the lighting module 701 determines a rotation correction and permutes the connections of the crossbar switch 709 accordingly. These connections are between the LED drivers 707 and the LEDs 711. For example, in a square lighting module 701, the LEDs can be divided into four quadrants, where the permutation means that connections within one quadrant is re-routed to another quadrant.

As an alternative, the rotation correction can be performed by rearranging the incoming lighting data by means of the processor, before applying them to the LED drivers 707.

Figure 8A:
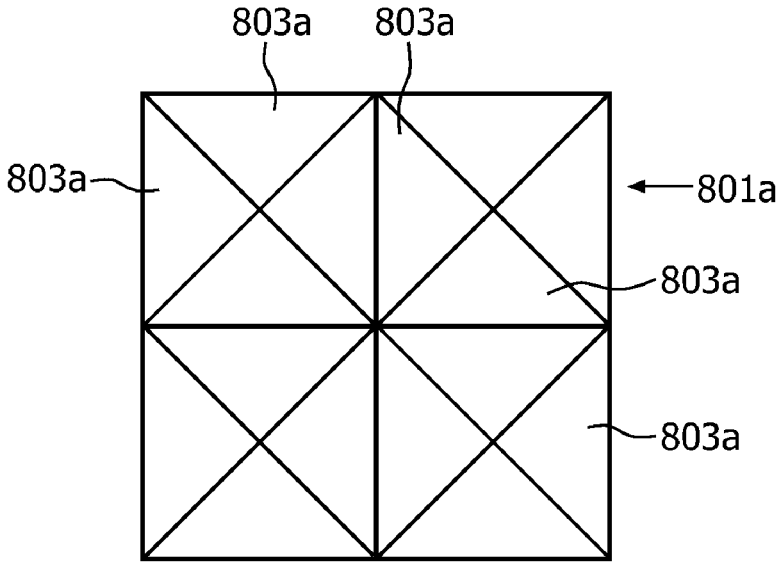
FIGS. 8*a-b* illustrates different types of sub-module structures of lighting modules.
Figure 8B:
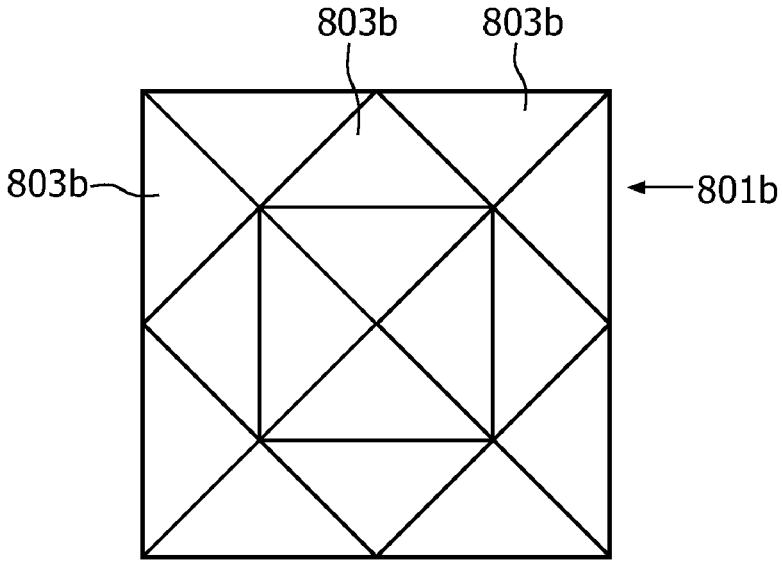

In one embodiment of the lighting system each lighting module 801*a*, 801*b* is divided into sub-modules 803*a*, 803*b*, with different configurations. Two examples are shown in FIGS. 8*a* and 8*b*. Each sub-module contains at least one LED and it individually lighted. Preferably each sub-module is capable of emitting a wide gamut of colors that can be changed at a high rate. Thereby it is possible to generate all kinds of fast moving lighting patterns across the panel. It is preferred that the parts of the lighting system are chosen such that video rate lighting patterns can be displayed. For example, a refreshing rate above 100 Hz is obtainable.

Further, as indicated above, the lighting modules comprise means to give feedback to the controlling device about data such as light emission, temperature and lifetime.

Figure 5A:
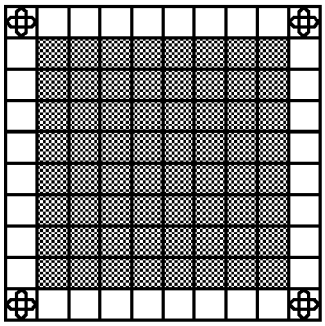
FIGS. 5*a-c* illustrates adaptation to changes in the lighting module arrangement.
Figure 5B:
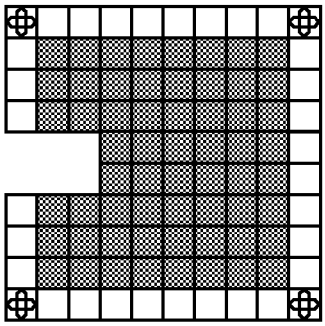
Figure 5C:
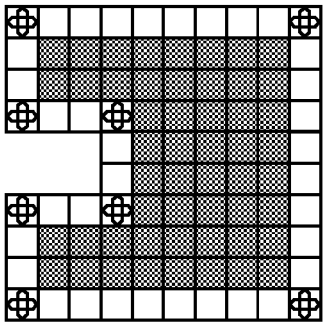

In FIGS. 5*a*-5*c* the adaptivity of this lighting system is exemplified. Initially, FIG. 5*a*, the lighting module arrangement is square shaped, and the light emission of the lighting modules along the edges form a frame of a different color than the rest of the arrangement. Then, FIG. 5*b*, six lighting modules are removed from the arrangement. This change triggers the execution of the learning procedure, etc. This results in a closure of the frame, where new lighting modules that have become edge modules after the removal are incorporated in the frame. Thus, for example, a restart is performed for one of the following reasons; a) the broadcasting network has been damaged, which requires a generation of a new network reaching all the lighting modules of the arrangement; b) a lighting pattern generation algorithm prescribes that a certain lighting pattern effect be upheld irrespective of the shape of the arrangement. In the latter case the algorithm, for example, may strive for continuation of the sub-pixeled border running along the new edges of the arrangement, as illustrated in FIG. 5*c*.

In FIGS. 9*a* and 9*b*, further, an example of LED distribution across the lighting module is shown. Thus, each lighting module 901, 903 has 16 LEDs L1-L16 and 16 LED drivers D1-D16. They are arranged in a 4×4 matrix, and they are numbered according to a physical orientation of the lighting module such that L1 is related to D1, starting from the upper left corner. However, when a lighting module is mounted with a deviating orientation the numbering starts from some other corner. The correction of the orientation of a lighting module 907 can be considered as a renumbering of the drivers such that D1 is relocated to the upper left corner.

In an embodiment of the method, all lighting modules acknowledge their existence to all sides at power-up. Thereby all lighting modules already know their neighbours when the token visits them for the first time. However, this embodiment increases the demands a higher level of timing of intervals for sending and receiving.

Above, embodiments of the method of controlling a lighting system and of a lighting system according to the present invention have been described. These should be seen as merely non-limiting examples. As understood by a skilled person, many modifications and alternative embodiments are possible within the scope of the invention.

Thus, the invention involves a method of controlling a lighting system including a plurality of polygonal lighting modules and a controlling device, which are able to communicate with each other. The lighting modules are arbitrarily arrange able, since each lighting module is able to communicate with neighboring lighting modules via communication units arranged at several sides of the lighting module.

The method includes a learning procedure for defining a lighting module arrangement and a communication network for communication between the controlling device and the lighting modules.

During the learning procedure a token is forwarded from lighting module to lighting module, while ensuring that all lighting modules are visited by the token; and geometric information about how the lighting modules are arranged in relation to each other is generated.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A method of controlling a lighting system that comprises lighting modules and a controlling device, which are configured to communicate with each other, wherein said lighting modules are arbitrarily arranged in an arrangement and each lighting module is configured to communicate with neighboring lighting modules via communication units arranged at several sides of the lighting module, the method comprising the act of:

connecting the controlling device to a first communication unit of a first lighting module of the lighting modules, the first communication unit being at a first side of the first lighting module;

connecting a second communication unit of the first lighting module to the arrangement through a second lighting module of the lighting modules, wherein the second communication unit is at a second side of the first lighting module, the first communication unit being different from the second communication unit, and the first side being different from the second side;

performing a learning procedure for defining a lighting module arrangement and a communication network for communication between the controlling device and the lighting modules;

wherein the learning procedure comprises the acts of:

forwarding a token from one lighting module to another lighting module, while ensuring that all the lighting modules are visited by the token; and concurrently providing geometric information about how the lighting modules are arranged in relation to each other.

2. The method according to claim 1, wherein said token carries an address which is assigned to a receiving lighting module at a first visit of the token to that the receiving lighting module, and wherein said address is updated at the token after each assignment.

3. The method according to claim 1, wherein said act of concurrently providing geometric information comprises determining in what direction the token is to leave a lighting module, and communicating direction information about said direction to the controlling device.

4. The method according to claim 3, wherein said controlling device determines a size and a shape of the lighting module arrangement using said direction information.

5. The method according to claim 3, wherein said act of concurrently providing geometric information further comprises communicating direction information to a next lighting module which the token is to visit next.

6. The method according to claim 5, wherein said learning procedure further comprises the act of determining a rotation correction of a default orientation of a lighting module at reception therein of said direction information.

7. The method according to claim 1, wherein said learning procedure further comprises the act of storing, at each lighting module, information about at which side of a visited lighting module said token was received at a first visit to the visited lighting module.

8. The method according to claim 1, wherein said lighting modules are in one of at least two different states, including an idle state in which said lighting modules are ready to receive communication from any side, and an active state in which said lighting modules send communication in at least one direction.

9. The method according to claim 1, further comprising the act of performing an optimization procedure for optimizing said communication network, said optimization procedure configuring at least one optimized data path through said lighting module arrangement, for sending data from said controlling device to said lighting modules.

10. The method according to claim 9, wherein said controlling device determines said at least one optimized data path based on knowledge about said lighting module arrangement.

11. The method according to claim 10, wherein a data path is defined as a unidirectional path by said controlling device sending communication control data to each lighting module, to be included in the data path, wherein said communication control data defines at least one of the communication units of the lighting module to receive data only, and at least one of the communication units of the lighting module to send data only.

12. The method according to claim 1, further comprising the acts of detecting an amendment of said arrangement and adapting control of the lighting modules accordingly.

13. The method of claim 1, further comprising the act of, while the token is moving throughout the arrangement, converting a trace of the token from one lighting module to another lighting module into a unidirectional return data path back to the controlling device.

14. The method of claim 1, further comprising the acts of:

sending a presence inquiry to the one lighting module from an inquiring lighting module; and sending a reply to the inquiring lighting module from only a side of the inquiring lighting module where the presence inquiry was received.

15. The method of claim 1, further comprising the acts of:

sending presence inquiries from sides of an inquiring lighting module to its neighbors to determine a result including the sides that the neighbors exist;

determining that a neighbor lighting module exists at a side of the inquiring lighting module if a reply to a presence inquiry from the side is received;

storing the result by the inquiring lighting module; and repeating the acts of sending, determining and storing for each of the lighting modules.

16. A lighting system comprising, lighting modules, wherein each of the lighting modules comprises at least one communication unit; and a controlling device for controlling the lighting modules, wherein the controlling device is connected to a first communication unit of a first lighting module of the lighting modules, the first communication unit being at a first side of the first lighting module, and a second communication unit of the first lighting module is connected to the arrangement through a second lighting module of the lighting modules, wherein the second communication unit is at a second side of the first lighting module, the first communication unit being different from the second communication unit, and the first side being different from the second side, wherein said lighting modules are arbitrarily arranged and each lighting module is configured to communicate with neighboring lighting modules via communication units arranged at several sides of the lighting module, wherein the lighting system is configured to be self-learning regarding the arrangement thereof, wherein the lighting system is configured to define said arrangement and a communication network for communication between the controlling device and the lighting modules, wherein the lighting system is configured to forward a token from one lighting module to another lighting module while ensuring that all the lighting modules are visited by the token, and to concurrently provide geometric information about how the lighting modules are arranged in relation to each other.

17. The lighting system according to claim 16, wherein said controlling device is arranged to detect changes of said arrangement and adapt the control of the lighting modules accordingly.

18. The lighting system according to claim 16, wherein each lighting module comprises a storage for storing information regarding which side of a receiving lighting module said token was received at a first visit to the receiving lighting module.

19. The lighting system of claim 16, wherein the lighting system in configured to, while the token is moving throughout the arrangement, convert a trace of the token from one lighting module to another lighting module into a unidirectional return data path back to the controlling device.

20. The lighting system of claim 16, wherein each of the lighting modules is configured to detect neighboring lighting modules by:

sending presence inquiries from sides of an inquiring lighting module to its neighbors to determine a result including the sides that the neighbors exist;

determining that a neighbor lighting module exists at a side of the inquiring lighting module if a reply to a presence inquiry from the side is received; and storing the result by the inquiring lighting module.

* * * * *